US006772719B2

(12) United States Patent
Schmidt et al.

(10) Patent No.: US 6,772,719 B2
(45) Date of Patent: Aug. 10, 2004

(54) HYDRAULIC VALVE LIFTER WITH OPERATING CONTROL SYSTEM

(75) Inventors: Robert Schmidt, Fellbach (DE); Holger Steffen, Stuttgart (DE); Thomas Stolk, Kirchheim (DE); Alexander von Gaisberg-Helfenberg, Fellbach (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 10/616,687

(22) Filed: Jul. 10, 2003

(65) Prior Publication Data

US 2004/0050351 A1 Mar. 18, 2004

(30) Foreign Application Priority Data

Jul. 10, 2002 (DE) ..... 102 31 110

(51) Int. Cl.[7] ..... F01L 9/02

(52) U.S. Cl. ..... 123/90.12; 123/90.16; 123/90.27

(58) Field of Search ..... 123/90.12, 90.11, 123/90.52, 90.53, 90.55, 90.56; 92/13, 181 P

(56) References Cited

U.S. PATENT DOCUMENTS 4,000,756 A * 1/1977 Ule et al. ..... 137/596.17
4,633,827 A * 1/1987 Buente ..... 123/90.55
5,570,621 A * 11/1996 Kabasin ..... 91/363 R
5,619,965 A * 4/1997 Cosma et al. ..... 123/322
6,318,325 B1 * 11/2001 Lechner ..... 123/90.55
6,352,059 B2 * 3/2002 Stolk et al. ..... 123/90.11

FOREIGN PATENT DOCUMENTS

DE 198 18 893 11/1999

* cited by examiner

*Primary Examiner*—Thomas Denion
*Assistant Examiner*—Ching Chang
(74) *Attorney, Agent, or Firm*—Klaus J. Bach

(57) ABSTRACT

In an operating system for a hydraulic valve clearance control element of an internal combustion engine, which includes a hydraulic fluid having a pressure that depends on the engine operating state and wherein the hydraulic clearance control element includes a pressure chamber in which a hydraulic fluid volume is maintained for adjusting the length of the hydraulic clearance control element and means for maintaining the fluid volume when, after engine shut down, the pressure of the hydraulic fluid supplied by an engine fluid pressure source drops below a certain value so as to maintain the hydraulic clearance control element at its operating length during engine shutdown, means are arranged on the hydraulic fluid supply line to the hydraulic valve clearance control element for releasing hydraulic fluid to reduce its pressure below the certain value immediately upon engine shut down to safely maintain the hydraulic clearance control elements at their operating length.

5 Claims, 2 Drawing Sheets

HYDRAULIC VALVE LIFTER WITH OPERATING CONTROL SYSTEM

BACKGROUND OF THE INVENTION

The invention relates to a hydraulic valve lifter or valve clearance control element with an operating control system in an internal combustion engine employing a hydraulic operating fluid having a pressure which is dependent on the engine operating state, particularly for use with electromagnetic valve drives.

Such a hydraulic valve lifter or valve clearance control element is known for example from DE 198 18 893 A1. In this clearance control element, a throttle passage extending from the pressure space to a low pressure return line is provided with a blocking valve, which is open only when the hydraulic fluid pressure exceeds a certain pressure value of the hydraulic fluid being supplied to the pressure space from the outside. The pressure value is so selected that; during normal engine operation, this blocking valve is open. As the hydraulic fluid, generally, the engine oil is used which is subjected to an operating pressure during engine operation. When the engine is shut down and the engine oil is therefore no longer under pressure the blocking valve automatically closes so that no lubricating oil can escape from the pressure space of the valve lifter. Such an oil discharge blockage is required when the engine is shut down in order to prevent the hydraulic valve lifters of those valves, which are open during engine shut-down, to collapse that is loose their normal operating length and become shorter during engine shut-down.

Valve clearance adjustment means of this type are used in connection with camshaft valve drives. Functional problems however may occur especially with electromotive valve drives.

An electromagnetic valve operating mechanism for example is shut down immediately when the engine is turned off. However, the oil pump which is generally driven by the engine crankshaft and which provides the lubricating oil supply is still in operation as long as the crankshaft rotates after the engine is shut off. As a result, the engine oil pressure does not necessarily drop at the same time as the engine is shut down with the result that the blocking valve which prevents engine oil from flowing out of the pressure chamber of the oil lifter is not timely closed. Consequently, while the engine is still rotating after the engine is shut down but the valve operating mechanism and consequently the valves are at rest, engine oil may still flow out of the pressure chamber of the valve lifter if the pressure chamber is pressurized by the relative movable counter parts of the valve lifter. In an electromagnetic valve drive the pressure chamber is normally pressurized by the valve opening and closing springs during engine shutdown as the valve is held in an intermediate base position between the closed and open positions.

In an electromagnetic valve operating mechanism, an improper operation of a valve clearance control element may cause failure of the electromagnetic valve operating mechanism whereby certain valves are not operated. In such a case, the discharge oil from the pressure chamber of the valve clearance control element is maintained because of the oil is at full pressure so that the valve operating length is reduced. In art electromagnetic valve this may result in a change of the start-out position of the electromagnetic valve actuator so that restarting of the actuator becomes impossible without servicing in a repair shop.

It is the object of the present invention to provide a valve operating system with a valve clearance control element by which operation of the valve, particularly an electromagnetically operated valve, is improved.

SUMMARY OF THE INVENTION

In an operating system for a hydraulic valve clearance control element of an internal combustion engine, which includes a hydraulic fluid having a pressure that depends on the engine operating state and wherein the hydraulic clearance control element includes a pressure chamber in which a hydraulic fluid volume is maintained for adjusting the length of the hydraulic clearance control element and means for maintaining the fluid volume when, after engine shut down, the pressure of the hydraulic, fluid supplied by an engine fluid pressure source drops below a certain value so as to maintain the hydraulic clearance control element at its operating length during engine shutdown, means are arranged in the hydraulic fluid supply line to the hydraulic valve clearance control element for releasing hydraulic fluid to reduce its pressure below the certain value immediately upon engine, shutdown so as to safely maintain the hydraulic clearance control elements at their operating length.

The invention is based on the general concept to permit closing of a blocking valve in order to retain the oil in the valve clearance control element under certain engine operating conditions when the oil pressure in the expansion chamber of the valve clearance control element is still too high for closing the blocking valve.

A high pressure in the pressure chamber of the valve clearance control element normally prevents a closing of the blocking valve. Means are therefore provided to reduce the oil pressure so as to close the blocking valve in order to retain the oil in the pressure chamber of the valve clearance control element in order to maintain proper clearance during engine shut-down.

The invention will be described below in detail on the basis of the accompanying drawings.

DESCRIPTION OF A PREFERRED EMBODIMENT

The embodiment described herein is specifically an electromagnetic valve operating system.

An engine intake or exhaust valve 1 is, in the shown embodiment, operated specifically by an electromagnetic valve drive 2. The electromagnetic valve drive 2 includes an actuator, which is held by spring force in an equilibrium position with regard to the spring-biased valve 1. When the engine is shut down, that is, when the valve operating mechanism is inactivated, the actuator of the valve drive 2 is maintained by the spring forces acting thereon in abase position out of which it can be actuated. If the actuator position in the valve drive 2 is displaced from its base position by a valve drive disturbance it may not be possible to reactivate the actuator and it would then be necessary for a service mechanic to readjust the actuator.

Figure 1:
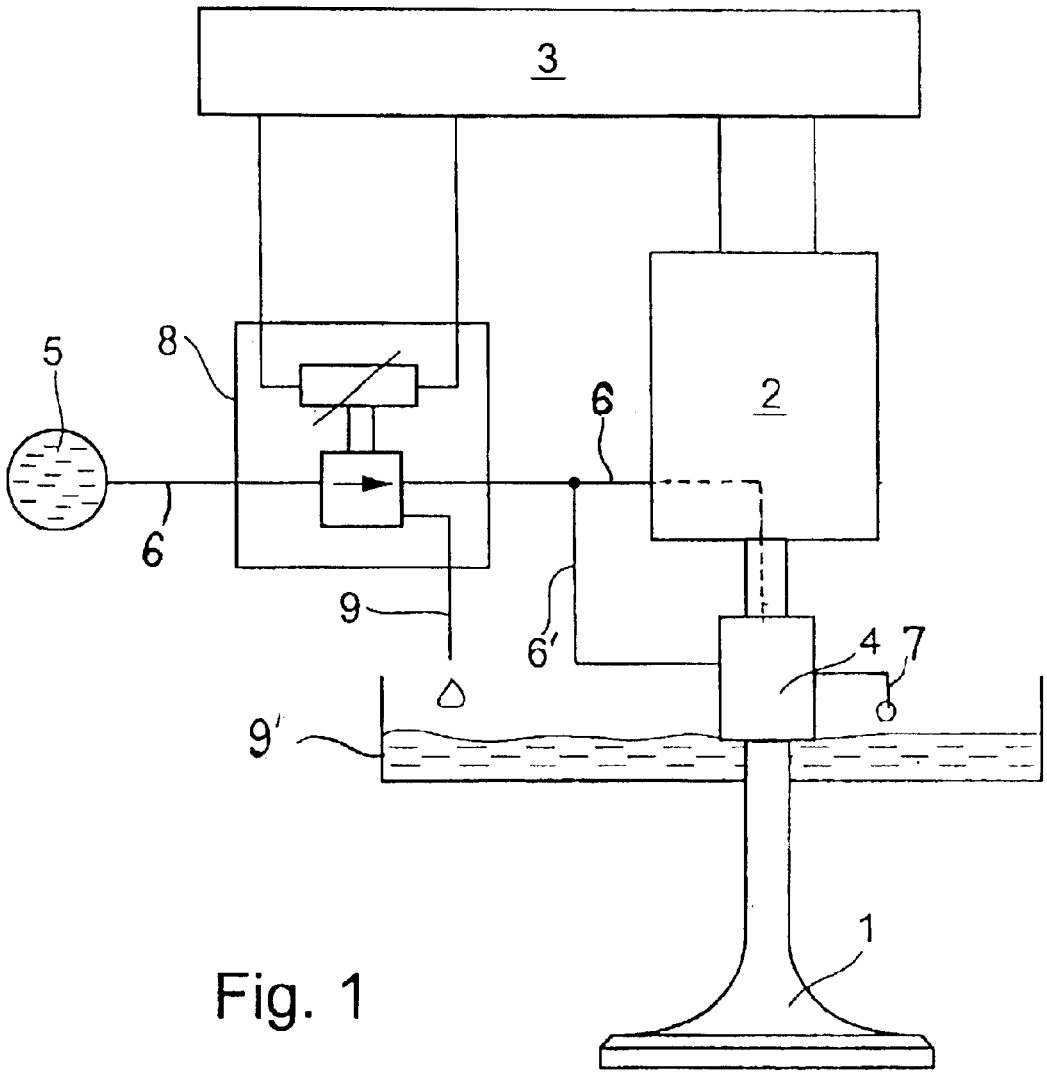
FIG. 1 shows schematically an arrangement for supplying hydraulic fluid to a hydraulic valve clearance control element of an internal combustion engine.

FIG. 1 shows only one of several engine valves of a valve drive 2, but all valve drives of an internal combustion engine are controlled by a common electronic valve control unite 3.

Figure 2:
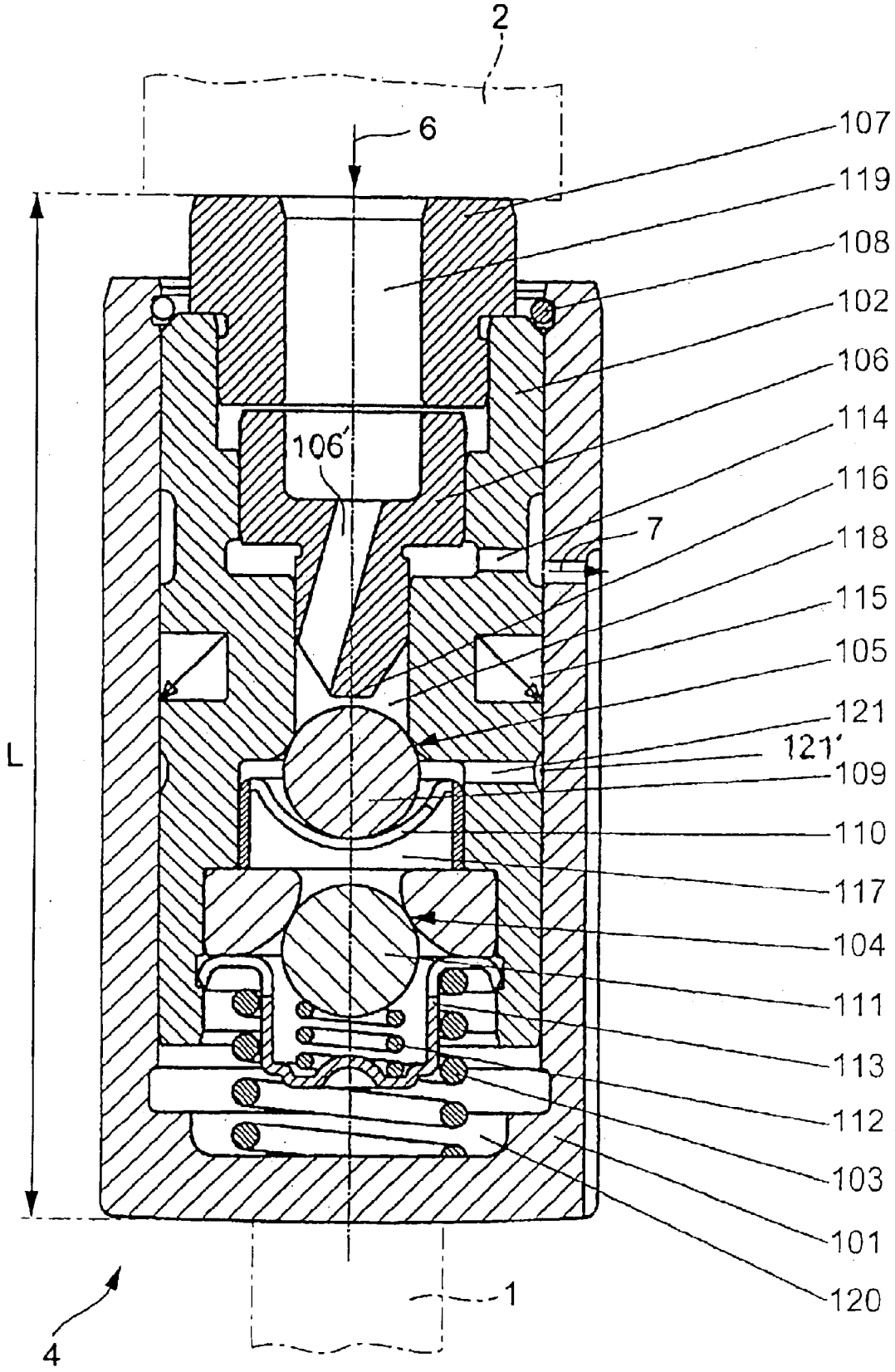
FIG. 2 shows, in an axial sectional view, a hydraulic valve clearance control element as it is used in engine valve operating mechanisms.

Between the valve drive 2 and the valve 1, there is generally arranged a hydraulic valve clearance control element 4, which is also called a hydraulic valve lifter. Such a clearance control element 4 may be in the form as shown in DE 198 18 893 A1, which is shown in FIG. 2. It is described below in detail as it may be used in the valve operating control system according to the present invention.

As hydraulic operating fluid for the operation of the clearance control element, that is the hydraulic valve lifter 4, engine oil from the engine oil lubricating circuit is used in the system shown in FIG. 1. The engine oil lubricating circuit is shown in FIG. 1 symbolically by a pressurized lubricating oil source 5. From this source pressurized lubricating oil is supplied to the hydraulic valve lifter 4 by way of a valve 8 and a supply line 6 by way of the valve drive 2. (Alternatively, the pressurized oil may be supplied directly to the valve lifter by way of line 6') Oil drained from the valve lifter 4 is drained by way of a return line 7. In the oil supply line from the pressurized lubricating oil source 5 to the hydraulic valve lifter 4 a pressure release valve 8 is arranged. From this pressure release valve 8, a drain line 9 extends to the oil sump 9', which is essentially at ambient pressure.

If the hydraulic pressure in the supply line 6 to the valve lifter 4 is to be reduced as a result of the engine operating state, the pressure release valve 8 is opened by the valve control unit 3, that is, oil is drained by way of the drain line 9.

In FIG. 1, the hydraulic valve lifter or valve clearance control element 4 is shown only schematically. FIG. 2 shows in detail such a hydraulic valve lifter as it is known from DE 198 18 893 A1. Its design and operation will now be described:

The valve lifter 4 comprises a cylinder part 101 and a piston part 102, which are biased apart that is to an extended position by a spring 103. In the extended position, the two parts 101, 102 determine the maximum length L of the hydraulic valve lifter 4. The relative movement between the cylinder part 101 and the piston part 102 is limited by a spring ring 108. The hydraulic fluid, that is lubricating oil from the lubricating oil circuit of an informal combustion engine, is supplied to the valve lifter 4 by way of a supply bore 119 in the pressure member 107. The supply bore 119 is in communication with the supply line 6 shown in FIG. 1.

The spring 103 is disposed in a pressure chamber 120 between the cylinder part 101 and the piston part 102. The pressure chamber 120 is closed by a one way valve 104 consisting of a closure member 111, a vehicle spring 112 and a valve cage 113. In flow direction ahead of the one way valve 104, there is another check valve 105, which includes a valve cage 110 with an integrated valve spring and a blocking valve member 109.

The blocking member 104 can be lifted off the valve seat 105 against the force of the spring 103 by an operating piston 106. The operating piston 106 includes at its upper end a greater effective surface exposed to the oil pressure than at its lower end. The resulting force on the operating piston 100 is applied by the engagement surface 116 to the blocking valve member 109 for opening the valve 105 by the engagement surface 116. Oil leaking out between the piston part 102 and the operating piston 106 flows through the drain passage 114 out of the hydraulic valve lifter 4 by way of the drain bore 7.

The piston 106 includes a bore 106' by way, of which pressurized oil can flow from the supply bore 119, which is in communication with the pressurized lubricating oil source (FIG. 1), to an intermediate space 118 and the space 117 between the check valves 104 and 105 to the pressure chamber 120.

In order to prevent oil from leaking out of the pressure chamber 120 an annular seal 115 is provided between the piston part 102 and the cylinder part 101. Furthermore, a communication passage 121 extends between an annular groove 121' and the space 117. Through this communication passage 121 leakage oil from the pressure chamber 120 may return to the space 117 when the valve 105 is closed and increase the closing force on the valve 105 provided by the spring 103.

In the hydraulic valve lifter 4 shown in FIG. 2 for example the check valve 105 may close even when the pressure source 5 is fully active. It is only necessary to open the pressure release valve 8 (FIG. 1) to reduce the pressure in the supply line 6, which is effective at the valve 105, to a value sufficiently low to close the valve 105.

When the pressure in the supply line drops or is reduced by opening of the pressure release valve 8, the valve 105 is no longer kept open by the operating piston 106. Rather, the valve closes to keep the oil locked in the pressure chamber 120 to prevent a collapse of the hydraulic valve lifter so as to maintain its length during engine shutdown.

What is claimed is:

1. An operating system for a hydraulic valve clearance control element (4) of an internal combustion engine having a hydraulic fluid with a pressure that depends on the engine operating state, said hydraulic valve clearance control element (4) comprising a cylinder part (101) and a piston part (102) defining a pressure chamber (120) having a hydraulic fluid supply opening and a hydraulic fluid drain, said piston part (102) being movable relative to said cylinder part (101) with changing volume of said pressure chamber (120) between opposite end positions, said pressure chamber (120) being in communication with a pressurized hydraulic fluid source (5) by way of said hydraulic fluid supply opening, a one way valve (104) disposed in said hydraulic fluid supply opening which is closed when the hydraulic fluid pressure of said hydraulic fluid source is below the hydraulic pressure in said pressure chamber (120), a blocking valve (105) arranged upstream of said one way valve (104) said blocking valve (105) being open only when the pressure of the fluid supply for said valve clearance control element is above a predetermined value, a hydraulic fluid drain including a passage (121) for returning leakage fluid from said pressure chamber to said fluid supply when said blocking valve (105) is open, and an electromagentically operated pressure release valve (8) arranged in the communication line (6) between said hydraulic fluid source (5) and said blocking valve (105) for releasing hydraulic fluid from said communication line (6) so as to reduce its pressure to a value at which said blocking valve (105) is closed immediately upon shut-down of the engine.

2. An operating system according to claim 1, wherein the hydraulic fluid operating the hydraulic valve clearance control element is lubricating oil of the engine lubricating oil circuit.

3. An operating system according to claim 1, wherein the pressure release valve (8) is open during engine shut down.

4. An operating system according to claim 1, wherein the pressure release valve (8) is open upon occurrence of a disturbance or defect in the valve drive.

5. An operating system according to claim 1, wherein said system includes a valve control unit (3) and said pressure release valve is opened by a signal supplied by said valve control unit (3).

* * * * *